US009383762B2

(12) United States Patent
Mallinson

(10) Patent No.: US 9,383,762 B2
(45) Date of Patent: Jul. 5, 2016

(54) VOLTAGE REGULATOR USING BOTH SHUNT AND SERIES REGULATION

(71) Applicant: ESS Technology, Inc., Fremont, CA (US)

(72) Inventor: A. Martin Mallinson, Kelowna (CA)

(73) Assignee: ESS Technology, Inc., Milpitas, CA (US)

( * ) Notice: Subject to any disclaimer, the term of this patent is extended or adjusted under 35 U.S.C. 154(b) by 0 days.

(21) Appl. No.: 14/580,851

(22) Filed: Dec. 23, 2014

(65) Prior Publication Data

US 2015/0177759 A1 Jun. 25, 2015

Related U.S. Application Data

(60) Provisional application No. 61/920,325, filed on Dec. 23, 2013.

(51) Int. Cl.
*G05F 1/575* (2006.01)
*G05F 1/618* (2006.01)

(52) U.S. Cl.
CPC ..... *G05F 1/575* (2013.01); *G05F 1/618* (2013.01)

(58) Field of Classification Search
CPC . H02M 3/00; H02M 3/04; H02M 2001/0003; G05F 1/46; G05F 1/461; G05F 1/56; G05F 1/613; G05F 1/618
USPC ..... 323/224, 225, 271–274, 268, 267, 323/282–288
See application file for complete search history.

(56) References Cited

U.S. PATENT DOCUMENTS 4,027,227 A * 5/1977 Engel ..... G05F 1/618 323/224
4,075,546 A * 2/1978 Barber ..... G05F 1/618 323/224
4,928,056 A * 5/1990 Pease ..... G05F 1/618 323/314
5,260,644 A 11/1993 Curtis
5,828,205 A * 10/1998 Byrne ..... G05F 1/56 323/268
5,856,740 A 1/1999 Rau et al.
5,966,004 A * 10/1999 Kadanka ..... G05F 1/618 323/224
6,141,193 A 10/2000 Mercer
6,466,422 B2 * 10/2002 Luo ..... G05F 1/575 361/18
6,967,470 B2 11/2005 Takabayashi
7,274,176 B2 * 9/2007 Mihara ..... G05F 1/575 323/269
7,423,416 B1 9/2008 Quinones et al.
2009/0256618 A1 10/2009 Yamawaki et al.
2013/0307506 A1 11/2013 Oh et al.

* cited by examiner

*Primary Examiner* — Rajnikant Patel
(74) *Attorney, Agent, or Firm* — Gard & Kaslow LLP

(57) ABSTRACT

A voltage regulator for providing a constant voltage to a circuit is described in which a series regulator acts as the current source for a shunt regulator and the series regulator in turn is controlled by the current diverted from the output by the shunt regulator. The current being diverted by the shunt regulator is measured, either directly or by measuring a related operating parameter. When current below or above a certain desired amount is being diverted from the load by the shunt regulator, a signal is sent to the series regulator causing the series regulator to provide more or less current respectively, so that the shunt regulator again diverts the desired amount of current and the output voltage remains constant. This configuration results in efficiency near that of a series regulator while maintaining the better frequency response of a shunt regulator.

10 Claims, 11 Drawing Sheets

VOLTAGE REGULATOR USING BOTH SHUNT AND SERIES REGULATION

This application claims priority from Provisional Application No. 61/920,325, filed Dec. 23, 2013, which is incorporated by reference herein in its entirety.

FIELD OF THE INVENTION

The present invention relates generally to digital circuits, and more particularly to voltage regulators for such circuits.

BACKGROUND OF THE INVENTION

Digital circuits often comprise or include logic circuits which have a speed of operation based upon their delay time, which in turn varies with the applied power supply voltage. This variation in delay time can be a source of jitter in the logic system. One solution to this jitter problem is the introduction of a regulator which holds the voltage provided to the logic circuit constant, thus lessening the jitter. For example, a regulator may be made to operate from a typical 1.2 volt (V) power supply and generate an 800 millivolt (mV) constant voltage for the critical elements of the logic design, such as the delay elements in a delay line.

A regulator designed for this purpose should have certain characteristics in order to properly maintain a steady voltage. First, the output voltage must be provided even when the input voltage is high or low. A typical specification might call for the regulator to provide the desired output when the input voltage varies by +/−15%. Thus, in the above example with an input voltage of 1.2 V, the input voltage may run from about 1.38 V to 1.02 V, and even at these high and low voltages the regulator should still produce the desired output voltage of 800 mV.

Secondly, to be effective the regulator should have a low output impedance even at high frequencies in the output terminal. If it does have a low output impedance, high frequency disturbances will create noise and introduce errors. Finally, it is desirable that the regulator draw the minimum power possible from the voltage supply so that battery life and excess heat are minimized.

One type of simple and inexpensive regulator used to maintain a steady voltage is a linear regulator. The resistance of the regulator varies in accordance with the load on the output, resulting in a constant output voltage. A voltage divider network uses a transistor or other device as a regulating device which is made to act like a variable resistor. The output voltage is compared to a reference voltage to produce a control signal to the transistor, and the transistor continuously adjusts to maintain a constant output voltage. With negative feedback and good compensation, the output voltage is kept reasonably constant.

All linear regulators require an input voltage that is at least some minimum amount higher than the desired output voltage. That minimum amount of excess voltage is called the dropout voltage. In a case where the difference between the supply voltage and the desired output voltage is small, such as the example above of 1.2 V and 800 mV (and as is common in low-voltage power supplies for digital logic circuits), the regulator must be of what is known as a "Low Dropout voltage" type (LDO).

Linear regulators are often inefficient. Because the regulated voltage of a linear regulator is always lower than input voltage, the input voltage must be high enough to always allow the active device to drop some voltage. Further, since the transistor is acting like a resistor, it will waste electrical energy by converting the difference between the input voltage and the regulated output voltages to waste heat.

Linear regulators exist in two basic forms, series regulators and shunt regulators. In the series regulator, the regulating device is placed between the source and the regulated load. In a shunt regulator, the regulating device is placed in parallel with the load. FIG. 1 shows a prior art series regulator, and FIG. 2 shows a prior art shunt regulator.

Series regulators are the more common form. As can be seen in FIG. 1, the series regulator 100 works by providing a path from the supply voltage DVcc to the load resistance 102 through a variable resistance created by a transistor 104. The output voltage Out is equal to the voltage drop over the load impedance, here shown as resistor 102, and is fed back to op amp 106. Op amp 106 is a differential amplifier and amplifies the difference between Out and a voltage from capacitor 108 (in this example, the desired output voltage of 800 mV), and its output remains stable when its inputs are the same.

The output of op amp 106 is fed to the gate of transistor 104, and controls the current passing through transistor 104. Series regulator 100 is thus a closed loop which operates to maintain an output voltage by controlling the amount of current delivered to the load resistance 102. If the current delivered results in the output voltage being too high, the current is reduced, while if the current delivered results in the output being too low it is increased. By this mechanism, a stable output voltage is obtained. The power lost and dissipated as heat is equal to the power supply output current times the voltage drop in the regulating transistor 104.

By comparison, the shunt regulator 200 of FIG. 2 works by providing a fixed current source 202 along with the supply voltage DVcc. The fixed current flows through two paths rather than one as in the series regulator, one path through the load impedance, again shown as a resistor 204, and a second path through the variable resistance provided by transistor 206. The current through transistor 206 is diverted away from the load resistance 204 and flows to ground; it is this current path around the load resistance 204 that provides the regulation of voltage. Like op amp 106 of series regulator 100 in FIG. 1, op amp 208 is a differential amplifier and similarly amplifies the difference between Out and a voltage from capacitor 210 (in this example again the desired output voltage of 800 mV), and is similarly stable when its inputs are the same.

It may be seen that shunt regulator 200 functions somewhat like a zener diode, i.e., the regulator 200 exhibits an abrupt change in incremental resistance at a distinct voltage, i.e., the regulated voltage or zener voltage. Below this voltage the impedance is high, since the effective impedance of transistor 206 is very high and the combined parallel impedance of transistor 206 and load resistor 204 is close to the impedance of load resistor 204, while above this voltage the impedance is low since the effective impedance of transistor 206 is lower, reducing the combined impedance.

This abrupt change in incremental resistance allows the shunt regulator 200 to provide a stable output voltage for a wide range of load conditions at the same regulated or zener voltage. In addition, compared to a series regulator in which the output impedance increases with frequency, a shunt regulator has a lower output impedance as frequency increases and thus may work better in suppressing jitter. FIG. 3 shows curves of impedance over a frequency range for typical series and shunt regulators. As may be readily seen, the impedance of both regulators is about the same until about 50 kilohertz (KHz) or so. However while the impedance of the shunt regulator is constant to about 100 megahertz (MHz), and even drops above that frequency, the impedance of the series regulator increases significantly over about 100 kilohertz (KHz).

However, this flexibility with respect to load conditions and frequency comes at a price. The shunt regulator 200 only works because it wastes current, i.e., it always sinks more current than the maximum current expected, and will thus drain a battery quickly. For example, as shown shunt regulator 200 shows an 8 kilohm (kΩ) load on the 800 mV output; that 8 kΩ load draws 100 microamps (uA), but the shunt regulator 200 wastes another 100 uA or so in the transistor 206. Because the shunt regulator uses more than the "ideal" current, i.e., only what is necessary to go through the load resistance, the shunt regulator is not as efficient as a series regulator under the same conditions.

A designer is thus faced with a choice between a series regulator, which is more efficient but has high output impedance at high frequency, or a shunt regulator, which generally has an inherently low output impedance even at high frequency but is inefficient.

It would thus be desirable to find a simple solution that would combine the frequency response and load flexibility of a shunt regulator with the lower current, and thus lower power drain and waste heat, of a series regulator, for use with logic circuits and other types of electronic circuitry as well.

SUMMARY OF THE INVENTION

A voltage regulator is disclosed which provides a combination of a shunt regulator driven by a series regulator, thus achieving the benefits of both types of regulator and an improvement over the typical prior art solution.

One embodiment discloses a voltage regulator connected to a load, comprising: a series regulator connected to a power supply and configured to provide a current in an amount based upon a control signal; a shunt regulator configured to receive a portion of the current not passed through the load; a sensor configured to determine the portion of the current received by the shunt regulator and generate the control signal based upon the determination of the portion of the current.

Another embodiment discloses a voltage regulator for providing a voltage at a voltage output, comprising: a first transistor having a source configured to be connected to a power supply, a gate configured to receive a control signal, and a drain connected to the voltage output; a first differential amplifier having a non-inverting input connected to the drain of the first transistor and an inverting input configured to be coupled to a ground through a device providing a first reference voltage, and an output configured to provide a signal based upon the difference of the non-inverting input and the inverting input; a second transistor having a drain connected to the drain of the first transistor, a gate connected to the output of the first differential amplifier, and a source configured to be coupled to the ground through a first resistor; a second differential amplifier having a non-inverting input connected to the source of the second transistor and an inverting input configured to be coupled to the ground through a device providing a second reference voltage, and an output configured to provide a control signal based upon the difference of the non-inverting input and the inverting input, the output of the second differential amplifier connected to the gate of the first transistor; and a second resistor configured to be connected between the voltage output and the ground.

DETAILED DESCRIPTION OF THE INVENTION

Described herein is a voltage regulator for providing a constant voltage to a circuit in which a series regulator drives a shunt regulator, i.e., acts as the current source for the shunt regulator, and the series regulator in turn is controlled by the current diverted from the output by the shunt regulator.

The shunt regulator works much like a shunt regulator of the prior art by diverting current from the load when necessary to keep the output voltage at the desired level, while the series regulator acts as the current source for the shunt regulator. The current being diverted by the shunt regulator is measured, either directly or by measuring a related operating parameter. When current beyond a certain desired amount is being diverted from the load by the shunt regulator, a signal is sent to the series regulator causing the series regulator to provide less current, so that the shunt regulator again diverts the preselected amount of current and the output voltage remains constant. When too little current is diverted, the control signal causes the series regulator to increase the amount of current provided.

This approach has the benefits that the frequency response of the regulator is like that of the shunt regulator, i.e., having low impedance even at high frequencies, and that the amount of current consumed is that of the series regulator plus a small amount of overhead for the shunt regulator (the desired amount of current to be diverted), which will generally be significantly less than a typical shunt regulator alone.

Figure 2:
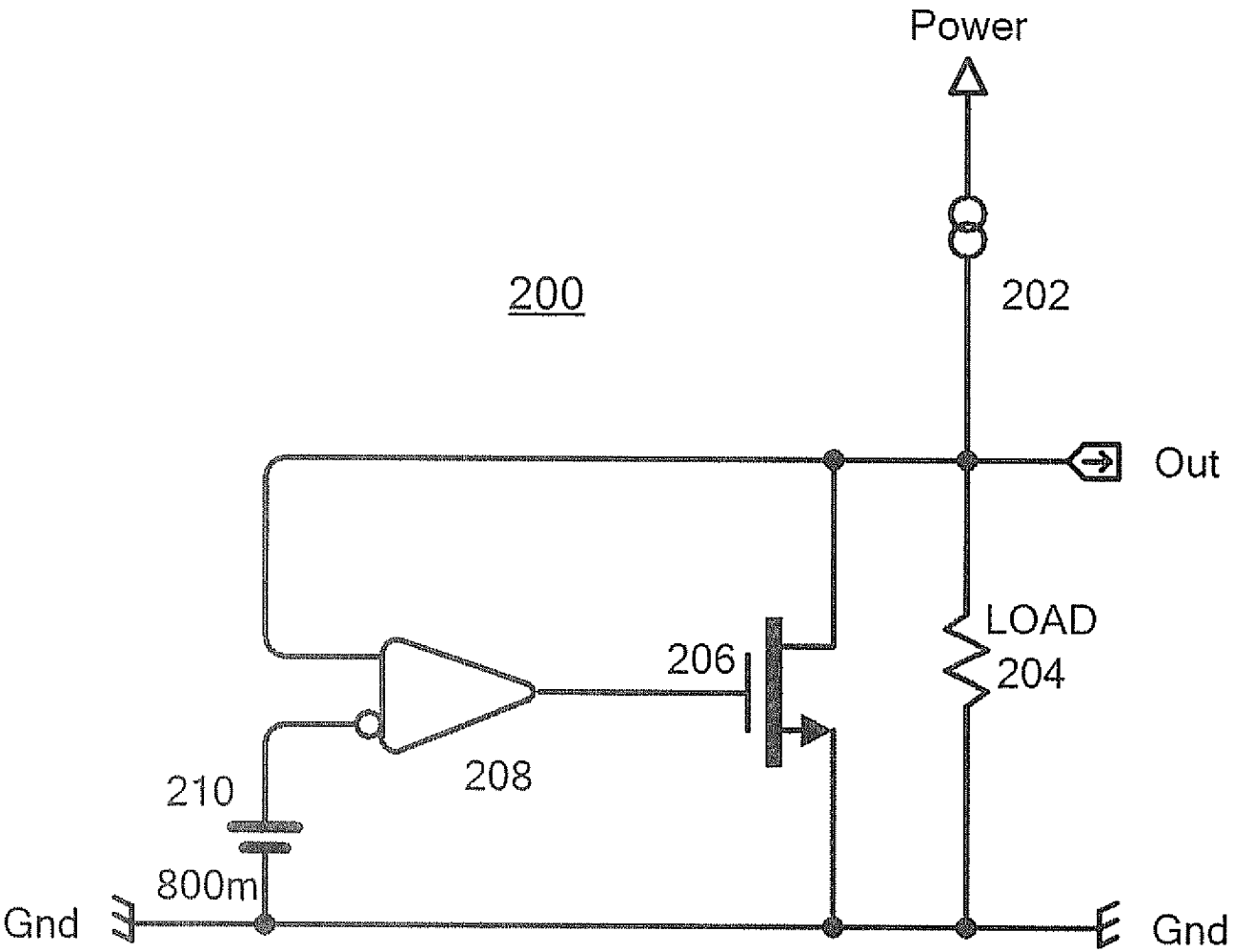
FIG. 2 (Prior art)
FIG. 2 is a schematic diagram of a typical prior art shunt regulator.
Figure 3:
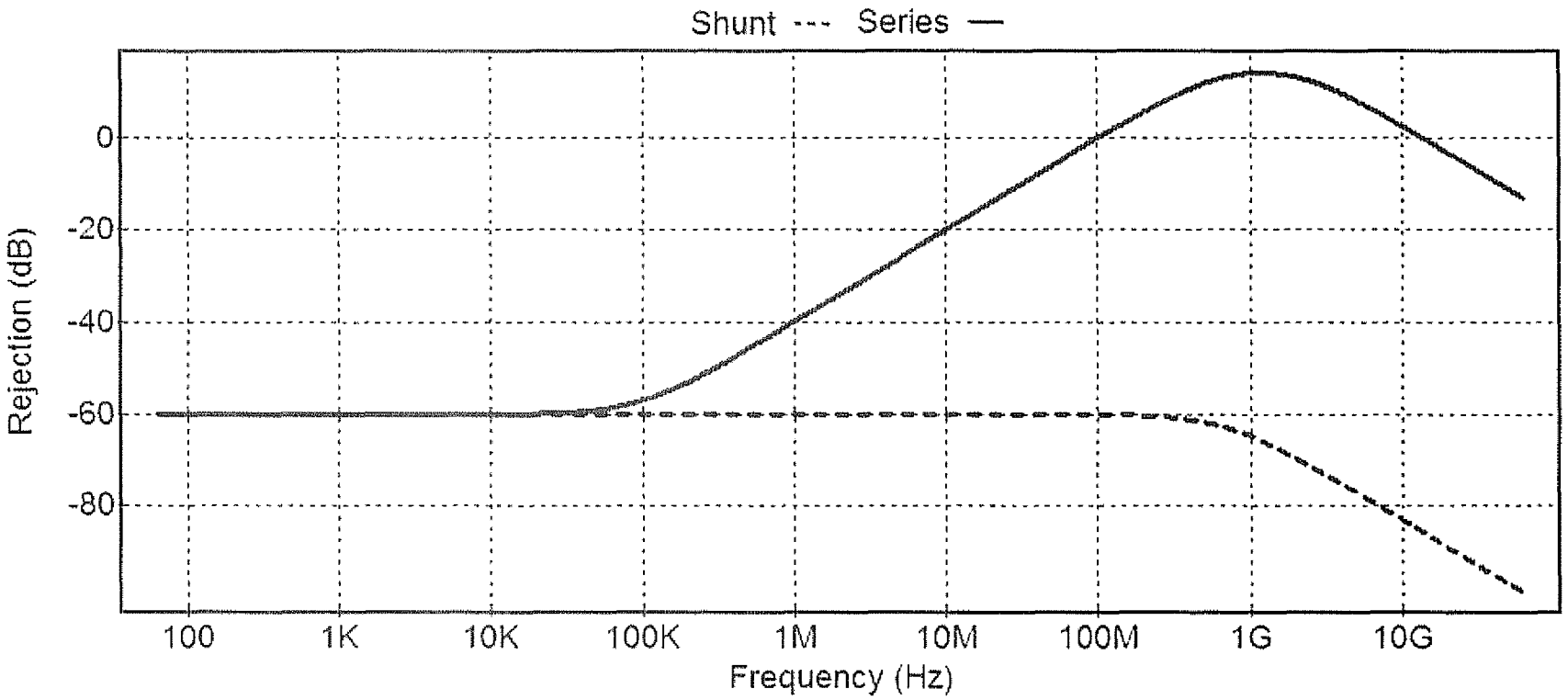
FIG. 3 is a graph showing the characteristic frequency responses of a series regulator and a shunt regulator.
Figure 4:
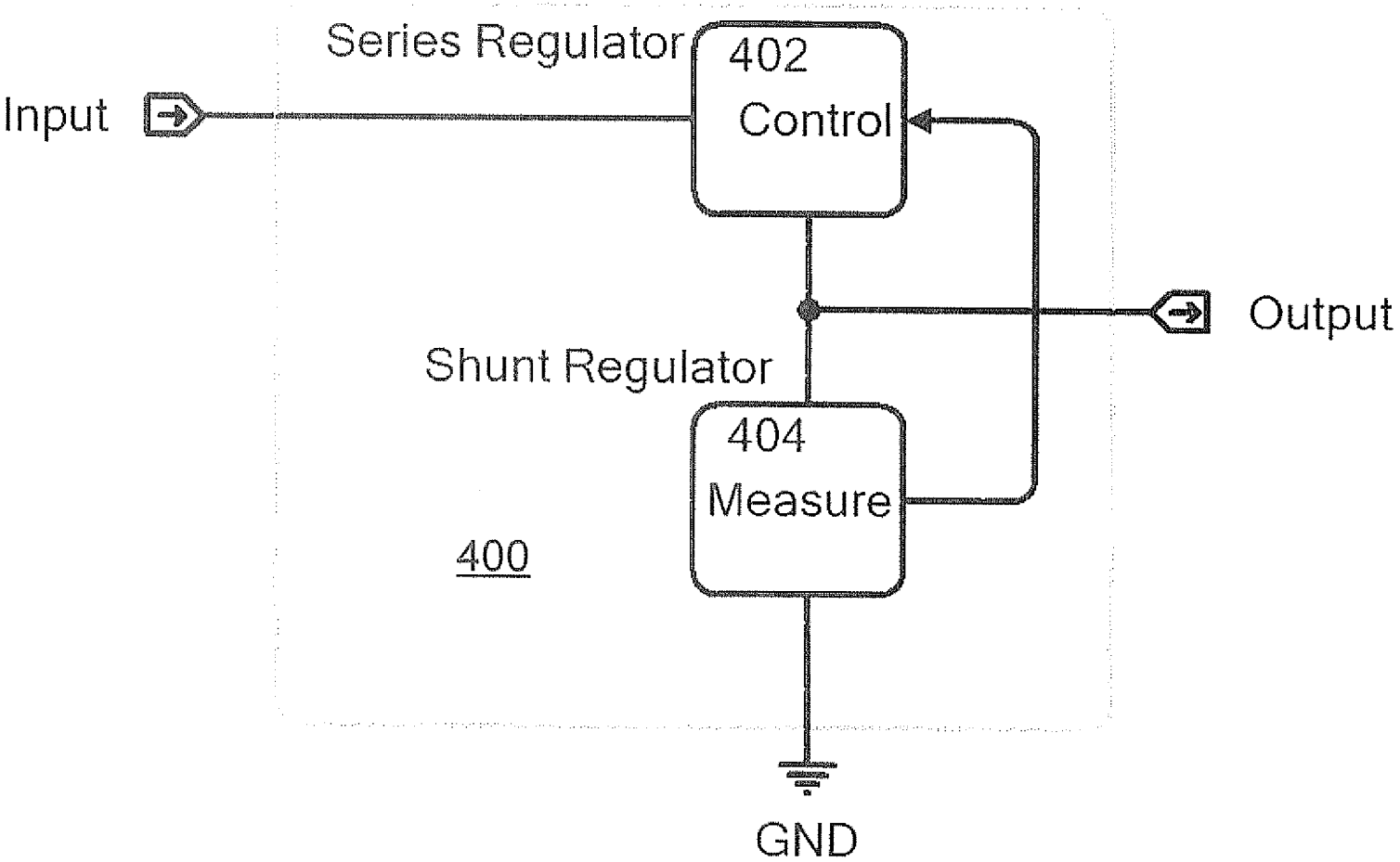
FIG. 4 is a block diagram of a combined series and shunt regulator according to one embodiment.

FIG. 4 is a block diagram illustrating how the series regulator and the shunt regulator are connected. The series regulator 402 receives the input voltage; the output of series regulator 402 is the output signal, and is also the input to shunt regulator 404. The current that shunt regulator 404 shunts to ground is measured, either directly by use of a sensor or measuring circuit, or indirectly by inspecting a surrogate parameter, for example, the operating point of the bypass device (i.e., the transistor 206 in the configuration of FIG. 2) in shunt regulator 404. The measured or otherwise inferred value of the shunt current is then used to control the series regulator 402 to maintain the shunted current at, or alter it to, an optimum value.

Figure 5:
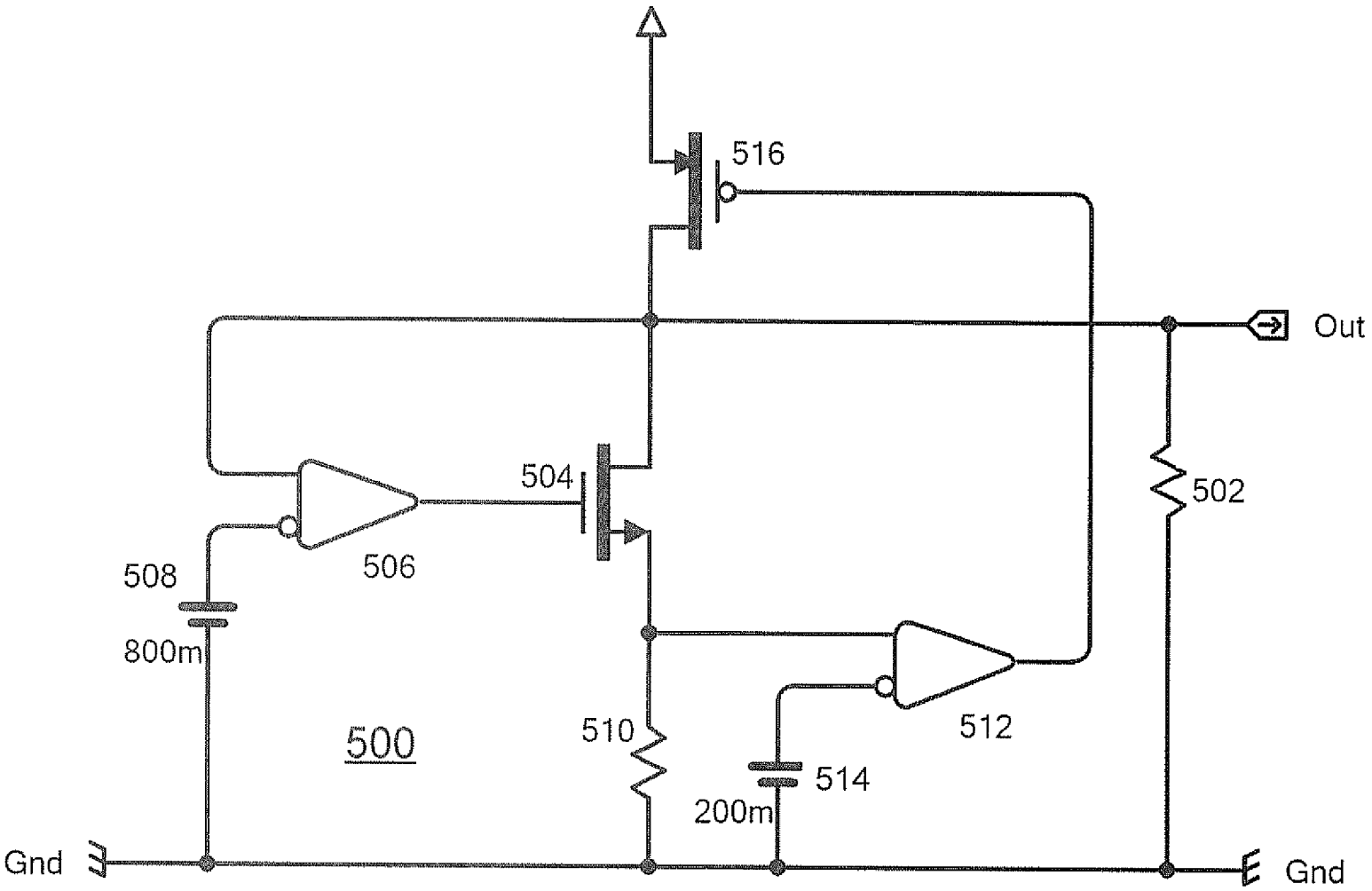
FIG. 5 is a schematic diagram of a combined series and shunt regulator according to one embodiment.

FIG. 5 shows a schematic diagram of a circuit 500 that is a combined series and shunt regulator that is more detailed than the block diagram of FIG. 4. A shunt regulator within circuit 500 contains a load impedance, represented by resistor 502, as well as a transistor 504, an op amp 506, and a reference voltage source 508. It will be apparent that, taken alone, these components are in a configuration similar to that of the prior art shunt regulator 200 shown in FIG. 2.

As in a prior art shunt regulator, the source of transistor 504 is connected to the output voltage Out, and transistor 504 operates as the variable resistance that shunts current from resistor 502 when necessary. The gate of transistor 504 is driven by op amp 506, operating to provide the difference between the output voltage Out and the voltage from the reference voltage source 508, again as in the prior art.

Figure 1:
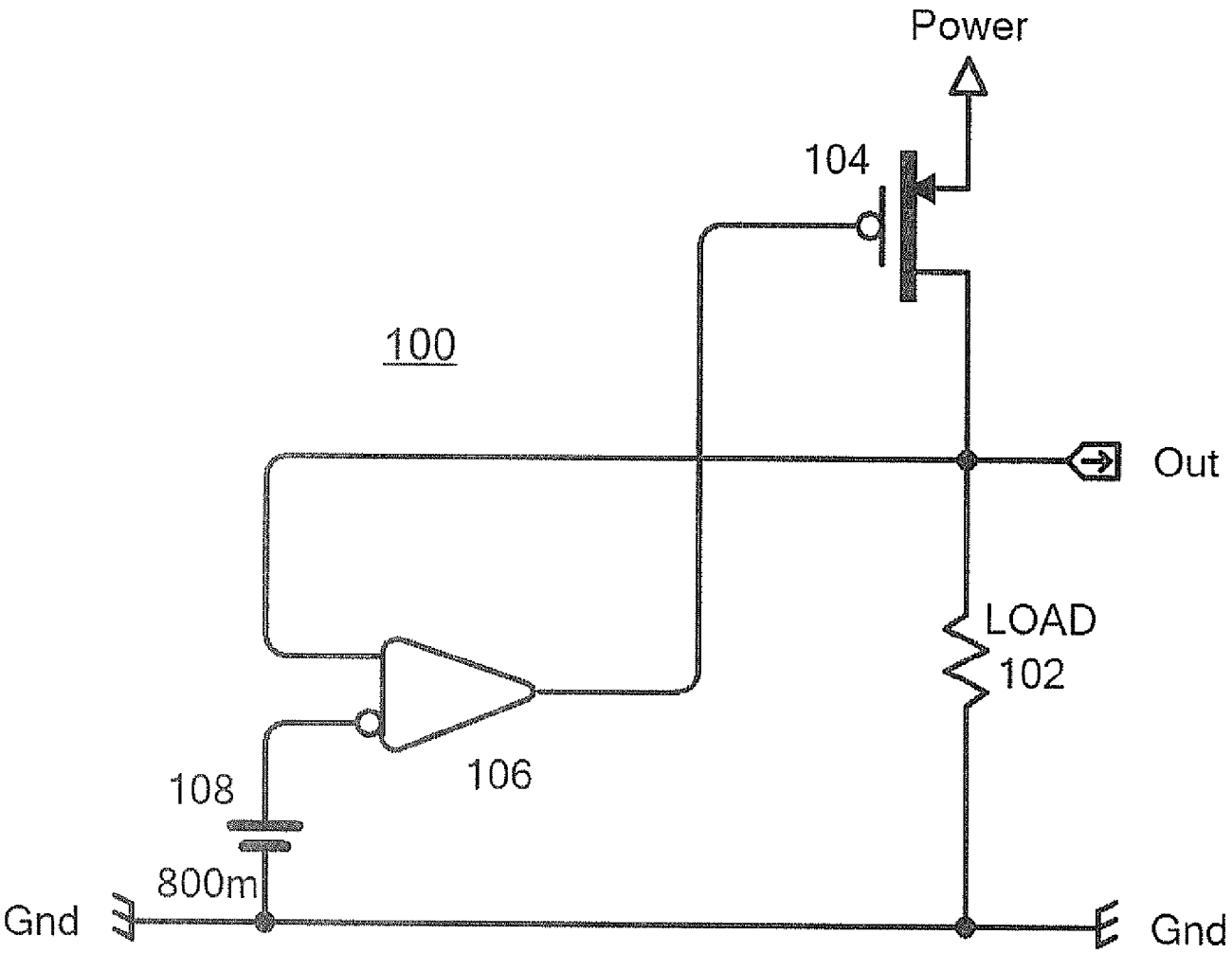
FIG. 1 (Prior Art)
FIG. 1 is a schematic diagram of a typical prior art series regulator.

Circuit 500 also contains additional components present which are connected in such a way as to also form a series regulator similar to that shown in circuit 100 of FIG. 1. It may be seen that resistor 502, a second op amp 512, a second voltage source 514, against which the shunt current is measured, and a second transistor 516 form a series regulator as shown in FIGS. 1.

It may be seen that there are small differences here in the implementation of the regulators as compared to the prior art. One input to op amp 512 is connected to the source of transistor 504, and thus coupled to the output voltage Out through transistor 504 rather than connected directly to Out as in circuit 100 in FIG. 1. Further, there is an additional component in circuit 500, resistor 510, the function of which is explained below; the drain of transistor 504 is coupled to ground through resistor 510 rather than being connected directly to ground as in the prior art shunt regulator of FIG. 2.

It will be apparent that the two regulators are interconnected. The source of second transistor 516, which again is part of the series regulator, is connected to voltage supply DVcc, acts as the current source for the shunt regulator; its drain is connected to, and acts as the current source for, resistor 502 and transistor 504. Also, as above, one input of op amp 512 of the series regulator is connected to the source of transistor 504 of the shunt regulator, rather than directly to the output voltage Out. In operation, the second op amp 512 adjusts the series regulator portion of circuit 500 to keep the current in the shunt portion of the circuit constant.

In the example above in which the regulated output voltage is 800 mV, the current flowing through resistor 502, having a resistance of 8 kΩ as shown, must be 100 uA. Further, if voltage source 514 provides a voltage of 200 mV to op amp 512, for stable operation there must also be 200 mV present on the other input to op amp 512; since sensing resistor 510 as shown has a resistance of 10 kΩ, there must be 20 uA flowing through resistor 510. Thus, the total current flowing from supply voltage DVcc must be 120 uA.

Now suppose that the load impedance increases by a factor of 10, so that resistor 502 appears to be 80 kΩ rather than 8 kΩ. To obtain an output voltage of 800 mV, the current through resistor 502 should be 10 uA rather than 100 uA. The first part of circuit 500 which will "see" this change is the shunt regulator control portion of circuit 500, through transistor 504. It will see that the load voltage is trying to increase, since there is still 120 uA flowing through transistor 516, even though now only 30 uA (10 uA for resistor 502 and 20 uA for resistor 510) is required.

As in the prior art, the response of the shunt regulator portion of circuit 500 is to rapidly increase the current drawn by transistor 504 to consume the extra 90 uA that is not needed by resistor 502, in order to pull the output voltage Out back down to the required 800 mV. The shunt regulator portion of circuit 500 will operate to hold the output to the regulated voltage with the bandwidth that it can provide, which, as with shunt regulators of the prior art, is generally the higher desirable bandwidth.

Now, however, there is more current flowing than is needed, i.e., the extra 90 uA that is no longer needed by the load. This will flow from transistor 504 through sensing resistor 510, increasing the current through resistor 510 from 20 uA to 110 uA, and the voltage across it from 200 mV to 2.2 V. Since the new voltage drop across resistor 510 of 2.2 V is now greater than the 200 mV comparison voltage on the other input of op amp 512, the output of op amp 510 will cause transistor 516 to reduce the current passing through transistor 516 until the output voltage Out is again at the regulated 800 mV, i.e. to reduce the current to the now required 30 uA.

This control of the output voltage by altering the current flowing through the load is similar to that which occurs in a prior art series regulator. Thus, circuit 500 is able to reduce the current required and have something approaching the efficiency of a prior art series regulator, rather than having the maximum current appropriate for a full load be consumed all the time. In addition, circuit 500 is able to maintain the bandwidth characteristic of a shunt regulator.

Note that circuit 500 will not be quite as efficient at a prior art series regulator, since there is a constant "overhead" current consumption by resistor 510, in this case 20 uA, in addition to the current required by the load. However, this is still likely to be substantially less than the current consumed in a prior art shunt regulator, which is always greater than the maximum anticipated load current by the amount needed for the shunt operation, and thus the total power consumption of circuit 500 over time is likely to be significantly less than the total power consumption of a typical shunt regulator.

There is still another benefit to circuit 500, which is that the regulation of DC voltage is greatly improved. Series and shunt regulators have open loop gain, and in the configuration of circuit 500 the gains of the two regulators is multiplied. Thus, if the series regulator has a low frequency open loop gain of 25 decibels (db) and the shunt regulator has a low frequency open loop gain of 30 db, the circuit 500 will have a low frequency open loop gain of 55 db.

Figure 6:
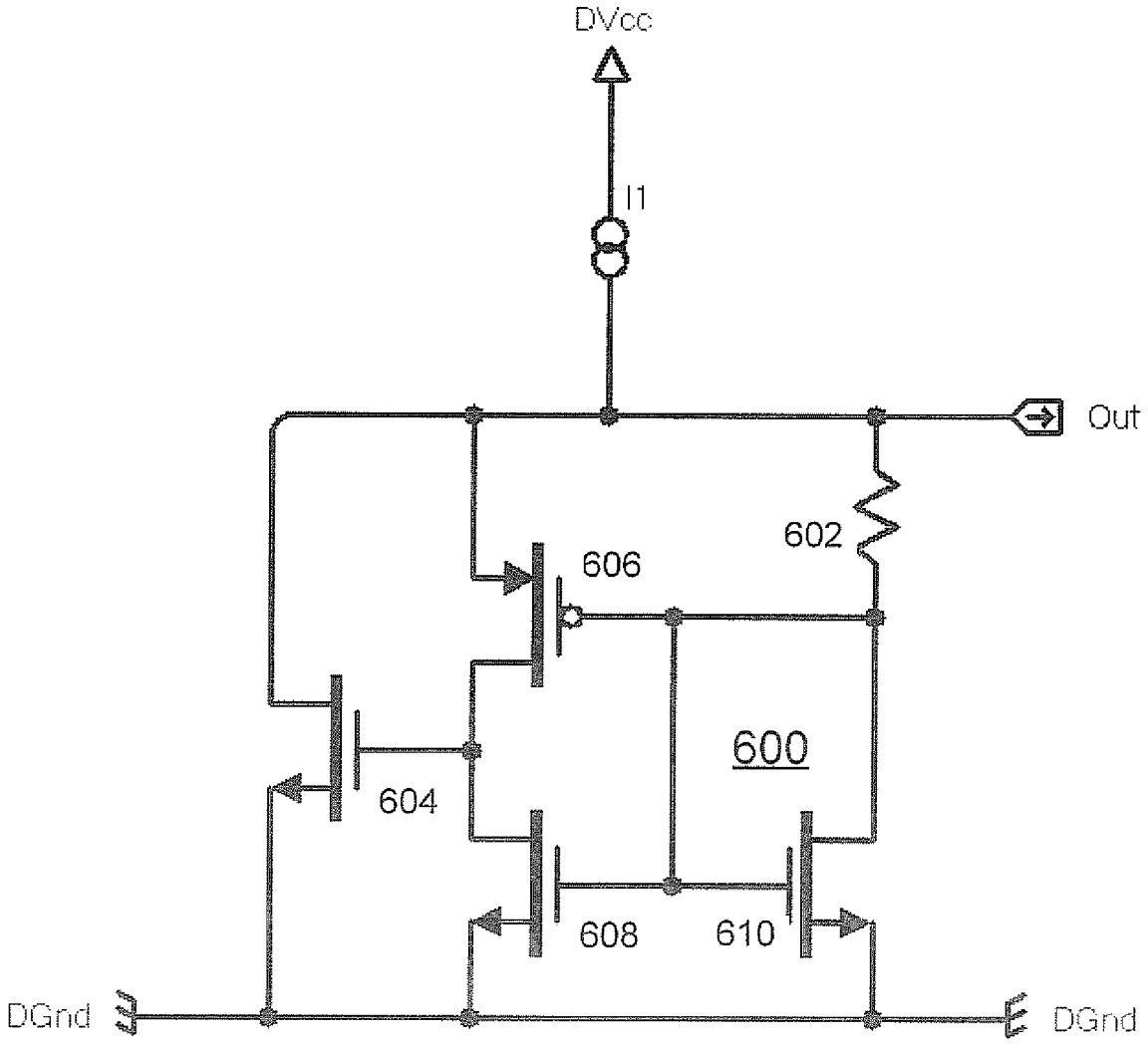
FIG. 6 is a schematic diagram of a transistor level implementation of a shunt regulator according to one embodiment.

In practice, circuit 500 may be implemented using transistors as now explained. FIG. 6 shows a transistor level implementation of a shunt regulator which may be used as the shunt regulator portion of circuit 500 of FIG. 5. (The shunt regulator portion will be added as described below.)

A load (not shown) is applied between the output voltage Out and the ground DGnd. Resistor 602, also connected between Out and DGnd, is used to bias the circuit, and transistor 604 is the shunt device, functioning to divert current when necessary, as is done by transistor 504 in FIG. 5. When the output voltage Out attempts to rise, transistor 606 will lift up the voltage on the gate of transistor 604, causing the output voltage to fall as transistor 604 diverts current. The stable operating point occurs when the output voltage Out is equal to the sum of the voltage drops from gate to source (Vgs) in transistors 606 and 610, which may be written as Vout=Vgs606+Vgs610. This occurs when the current flowing through resistor 602 is equal to the Vgs of transistor 606 divided by the resistance of resistor 602.

The op amp 506 of FIG. 5 is made up of two transistors 606 and 608. The non-inverting input of op amp 506 is thus the source of transistor 606, and the inverting input of op amp 506 is the gates of transistors 606 and 608. The voltage applied to the inverting input of op amp 506 in FIG. 5, which is applied to the gates of transistors 606 and 608 in circuit 600, is the Vgs of transistor 610 biased by resistor 602.

The four transistors 604, 606, 608 and 610, and the resistor 602, are sufficient to construct the shunt regulator portion of circuit 500 of FIG. 5. However, thus far there is no element that performs the function of resistor 510 of circuit 500, and thus no means to detect the shunt current flowing through transistor 604.

Figure 7:
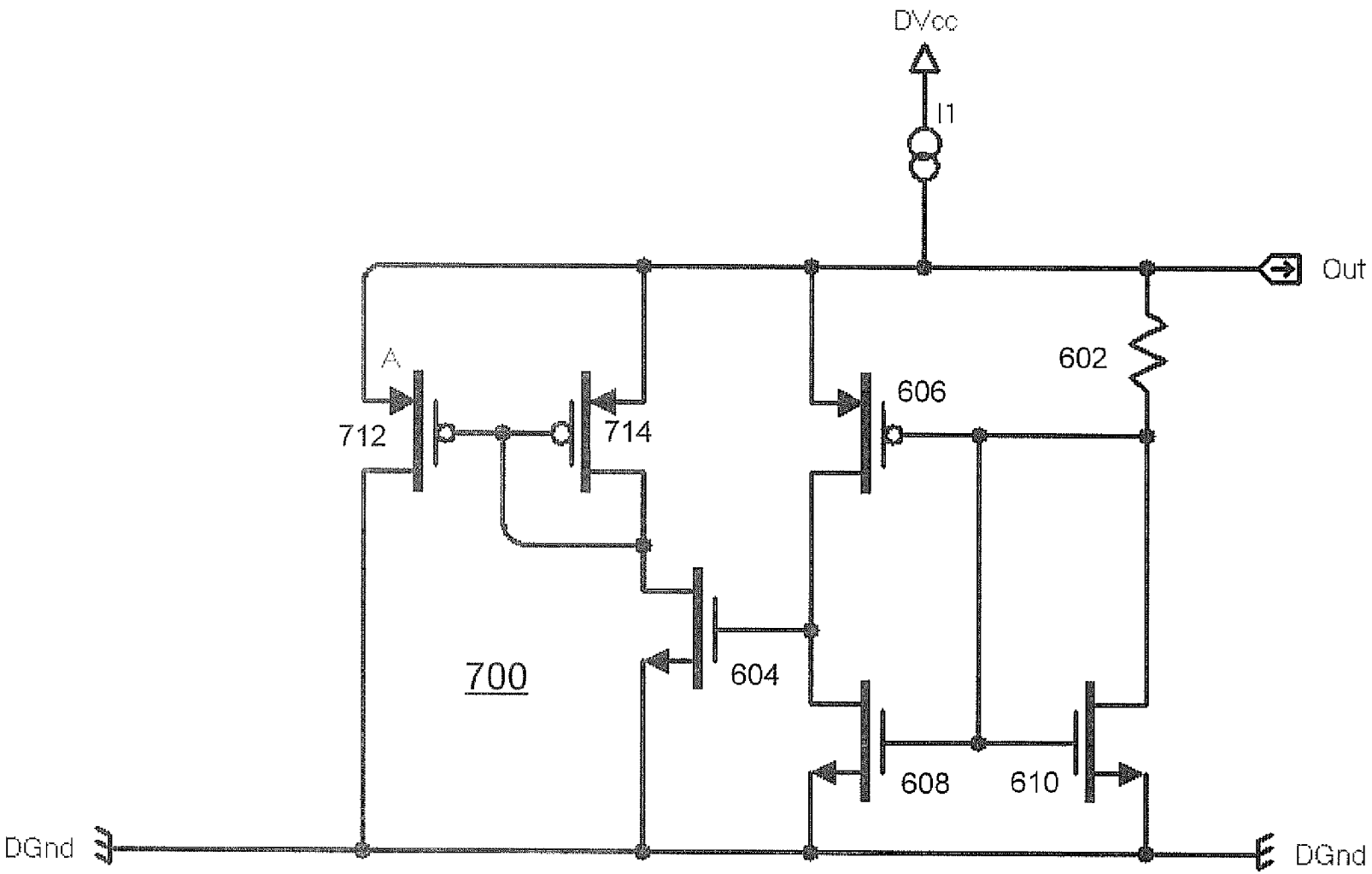
FIG. 7 a schematic diagram of a transistor level implementation of a shunt regulator including a sensor to detect and measure the shunted current according to one embodiment.

FIG. 7 illustrates one way in which the shunt current may be detected. FIG. 7 shows a circuit 700 which has the same components as the circuit 600 of FIG. 6 (with the same numbers), plus two additional transistors 712 and 714. The two additional transistors 712 and 714 provide the means necessary to detect the shunt current, as they act as a current mirror as is known in the art.

The use of the two additional transistors 712 and 714 also brings an additional benefit, in that they can multiply the gain of the current in transistor 604. That is, whatever current passes through transistor 604 to control the action of the shunt regulator, some multiple of that can actually be pulled out of the load point because transistors 712 and 714 may act not only as a current mirror but one with gain.

This is accomplished by using two transistors 712 and 714 which have different aspect ratios, i.e., the ratio of length to width of the drain channel, which thus alters the amount of current that can flow through the drain. Thus, transistor 712 may, for example, allow A times as much current to flow through as transistor 714, so that the combined current flow removed from the load by the shunt regulator becomes A+1 times the current flowing through transistor 604. Further, the current flowing through the drain of transistor 712 is now a measure of the shunt regulator current.

Figure 8:
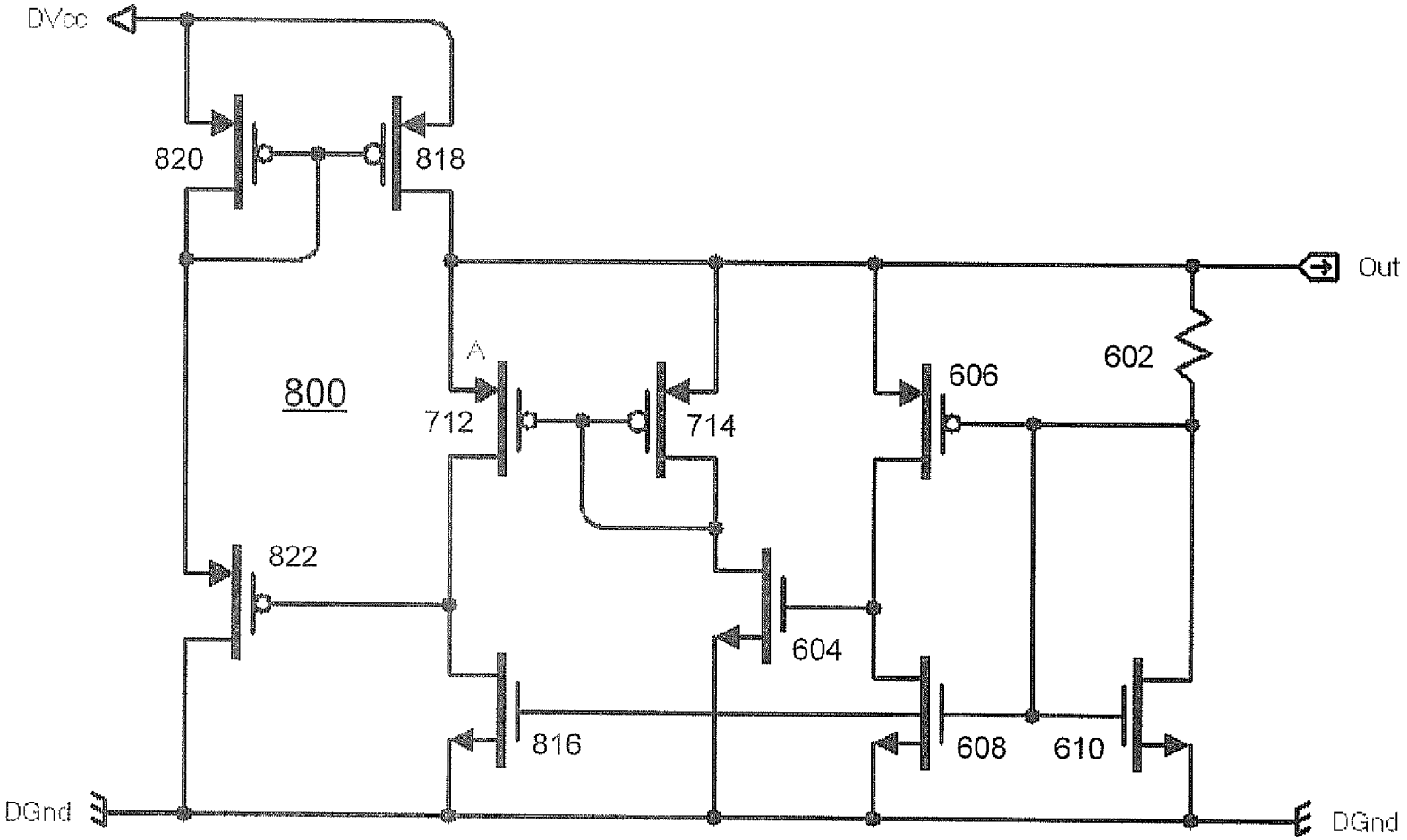
FIG. 8 is a schematic diagram of a transistor level implementation of a combined series and shunt regulator including a sensor to detect and measure the shunted current according to one embodiment.

The components to make the series regulator may be added to circuit 700 as shown in circuit 800 of FIG. 8, which corresponds to circuit 500 of FIG. 5. In circuit 800, transistors 816, 818, 820 and 822 have been added to the components from circuit 700, and comprise the series regulator. Transistor 818 is the series pass device, corresponding to transistor 516 in FIG. 5, and like transistor 516 is connected to the power supply DVcc. The function of the op amp of the series regulator, op amp 512 in FIG. 5, is performed by transistor 822, which delivers the difference between the shunt current (as measured by transistor 712) and a reference current (set by transistor 816, which mirrors transistor 610, and receives the voltage at its gate as at the gates of transistors 608 and 610); the source of transistor 822 is the "output" of the op amp, i.e., the difference between the currents. The equivalent of the voltage reference 514 of FIG. 5 is the reference current through transistor 816, and the shunt current flowing through transistor 504 in FIG. 5 is the current flowing through transistor 712. The difference between these currents drives the gate of transistor 822. Thus, the operation of op amp 512 of FIG. 5 operating in a voltage mode has been replaced with a current mode in FIG. 8, with the current difference driving the gate of transistor 822, which in turn drives series pass transistor 818.

A combination series-shunt regulator constructed in this fashion will show the frequency response of a prior art shunt regulator and a current efficiency close to that of a prior art series regulator. In addition, because the two regulator loops are operating together, the low frequency rejection is very high.

Figure 9:
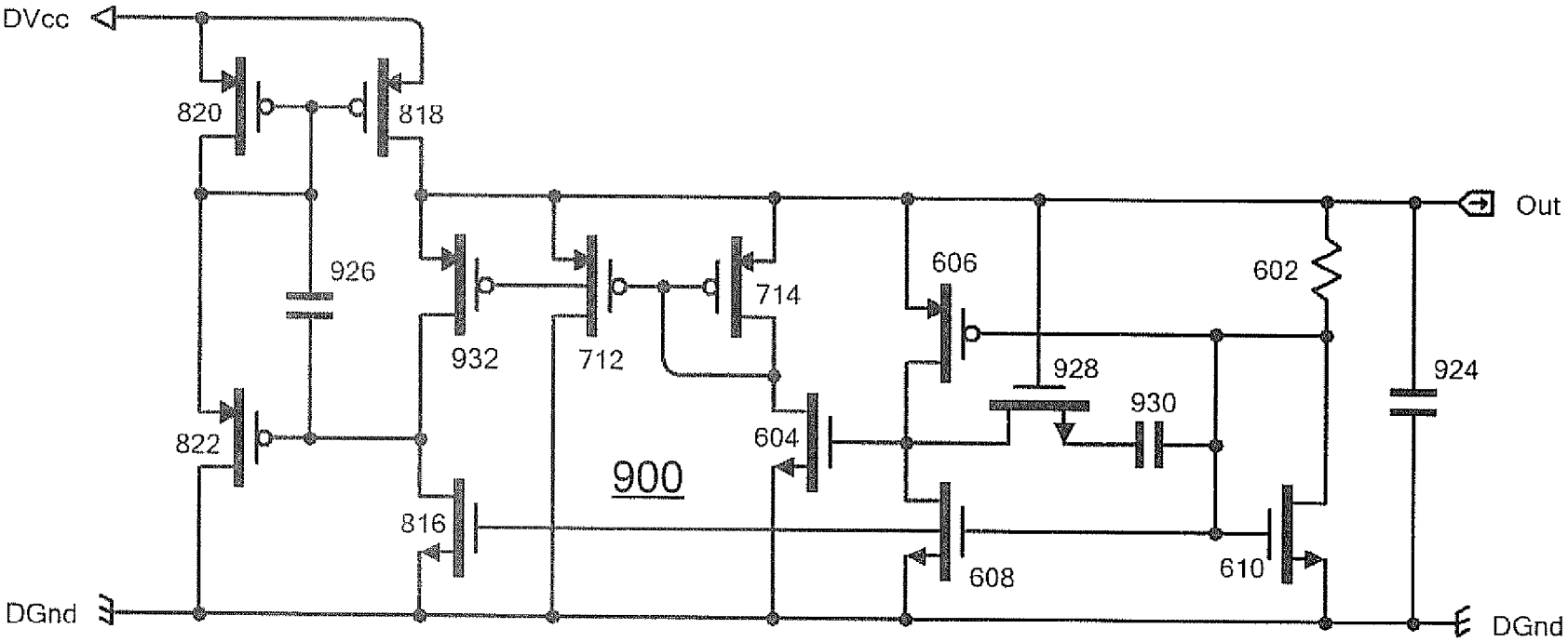
FIG. 9 is a schematic diagram of a transistor level implementation of a combined series and shunt regulator optimized for certain performance characteristics according to one embodiment.

FIG. 9 shows one embodiment of a circuit 900, illustrating how the circuit 800 of FIG. 8 might actually be implemented with an 0.15 micron CMOS (complementary metal-oxide-semiconductor) process. Most of the components are the same as those shown in circuit 800 of FIG. 8, and are labeled with the same reference numbers.

There are a few additional components in circuit 900 that provide specific implementation characteristics and are not shown in the basic circuit 800 of FIG. 8. Capacitor 924 provides a high frequency decoupling on the output. Capacitor 926 controls the phase shift in the series regulator section, while transistor 928 and capacitor 930 provide phase compensation in the shunt regulator section by providing a zero in the loop of the shunt regulator.

Transistor 932 is connected to share the voltages applied to the gate and source voltages applied to transistor 712. The drain current of transistor 932 is a constant fraction of the drain current of transistor 712 (which is the shunt current), and is used to divert part of the drain current of transistor 712 which I not needed in the series regulator portion of circuit 900.

Figure 10:
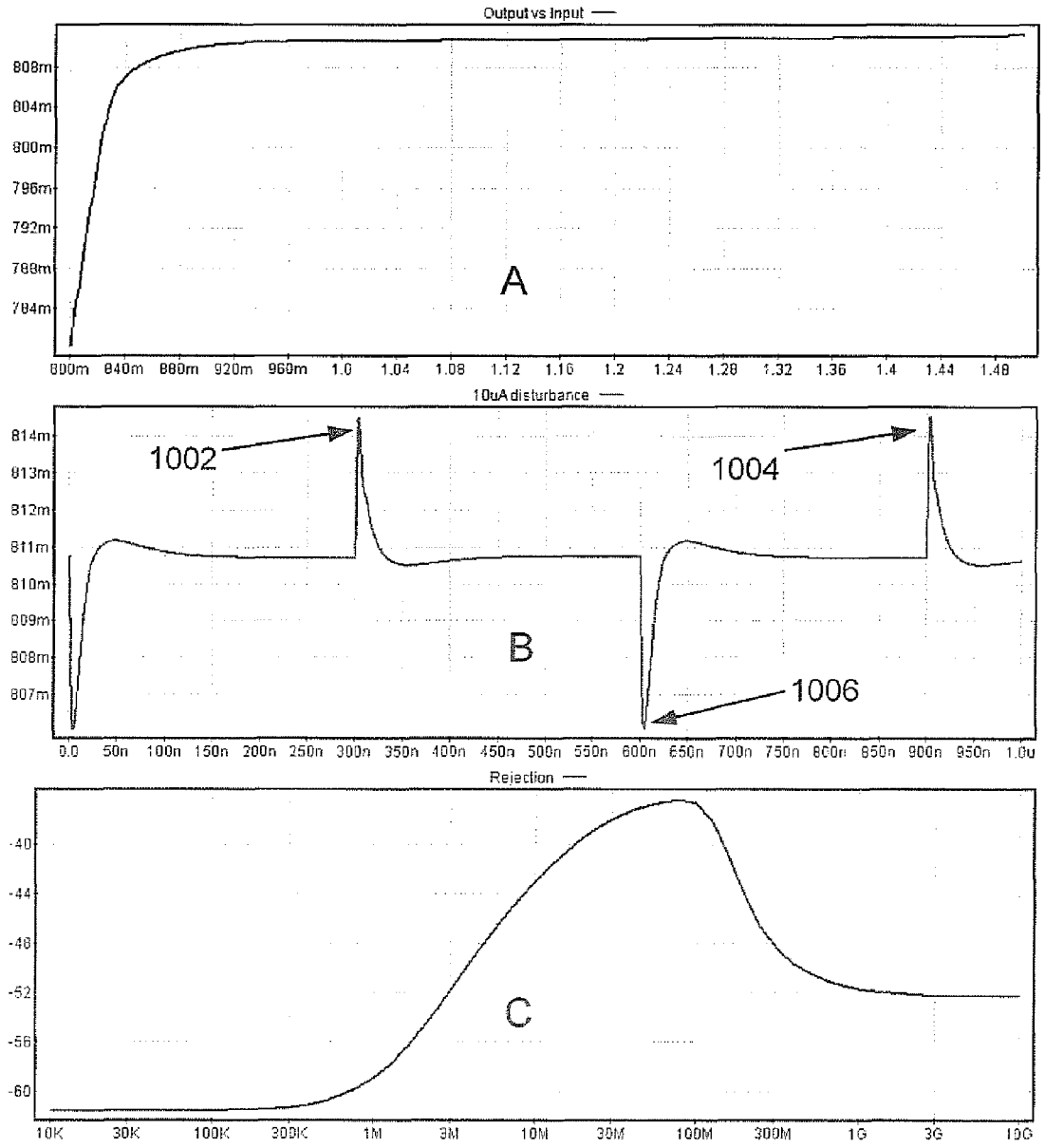
FIG. 10 shows several performance curves for the circuit of FIG. 9.

FIG. 10 shows several performance curves of the circuit 900 of FIG. 9. Curve A shows the output voltage Out (on the vertical axis) of the disclosed regulator versus the input voltage DVcc (on the horizontal axis). It shows that the regulation action begins below 1 V of input, and that the output voltage remains constant as the input voltage increases.

Curve B of FIG. 10 shows the response of the output Out to a disturbance in the load current. In curve B the current drawn by the output load has rapidly increased by 10 uA every 600 nanoseconds (as shown by the increases in output voltage on the vertical axis at points 1002 and 1004; time in nanoseconds is on the horizontal axis) and then decreased by 20 uA, i.e., to 10 uA below the original output current (as shown at point 1006. Curve B demonstrates that circuit 900 is stable and does not oscillate.

Curve C of FIG. 10 shows the rejection of circuit 900 to a disturbance of the input voltage DVcc (on the vertical axis) over a frequency range (the horizontal axis). At low frequencies the output moves by less than −60 db, i.e., one part in a thousand or 0.1%, but even in the worst case at about 100 megahertz (MHz) the output still moves by less than −30 db, or about 3%.

Figure 11:
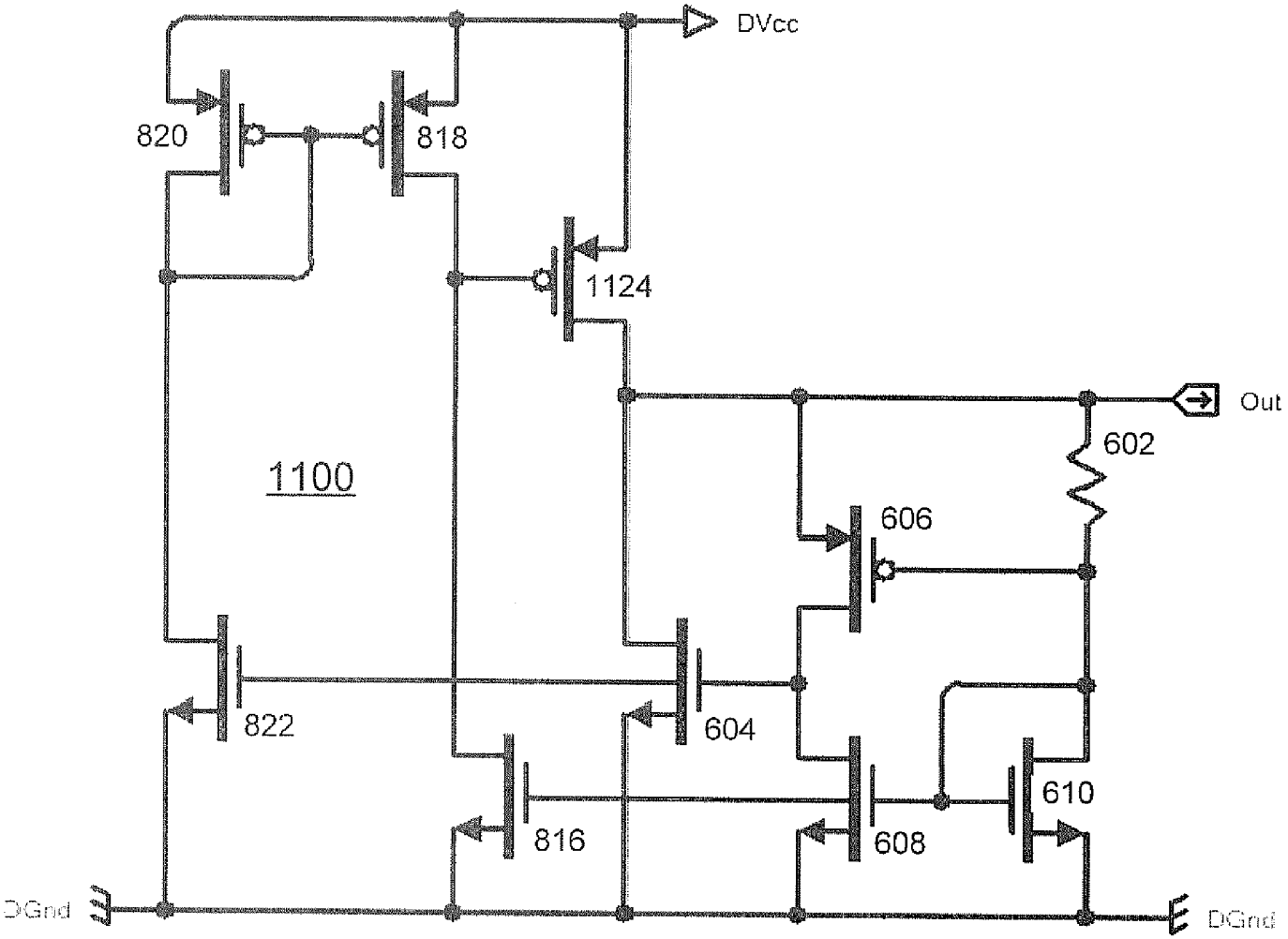
FIG. 11 is a schematic diagram of a transistor level implementation of a combined series and shunt regulator including a sensor to detect and measure a parameter related to the shunted current according to another embodiment.

FIG. 11 shows an alternative embodiment of the combined series and shunt regulator shown as circuit 800 in FIG. 8. Circuit 1100 also contains the components of the series and shunt regulators, and uses the same reference numbers for those components. Thus, as in circuit 800 of FIG. 8, in circuit 1100 the shunt regulator section consists of resistor 602 and transistors 604, 606, 608 and 610. Similarly, the series regulator is comprised of transistors 816, 818, 820 and 822.

However, in circuit 800 of FIG. 8 transistors 712 and 714 directly detect and measure the current bypassed by the shunt regulator, i.e., shunted through transistor 604. By contrast, in circuit 1100 of FIG. 11 transistors 712 and 714 have been replaced by transistor 1124. Rather than directly measuring the current bypassed by the shunt regulator as in circuit 800, transistor 1124 measures a surrogate parameter, the voltage present on the gate of transistor 604, through which the shunted current flows. The gate voltage of transistor 604 is a surrogate for the shunted current since it is directly related to the current flowing through transistor 604.

Thus, while not directly measuring the current bypassed by the shunt regulator as in circuit 800, the circuit 1100 of FIG. 11 achieves the same result by using the gate voltage on the shunt transistor as a surrogate for the current bypassed by the shunt transistor. One of skill in the art will appreciate that in some instances there may be other parameters that may also be used as surrogates for the bypassed current.

The disclosed system and method has been explained above with reference to several embodiments. Other embodiments will be apparent to those skilled in the art in light of this disclosure. Certain aspects of the described method and apparatus may readily be implemented using configurations or steps other than those described in the embodiments above, or in conjunction with elements other than or in addition to those described above.

For example, it is expected that the described apparatus may be implemented in numerous ways, including as a hard-wired circuit or embodied in a semiconductor device. Where elements are shown as connected, they may in some embodiments be coupled to each other through another element, for example, through another resistor. Different components may be added for different purposes, such as the capacitors of FIG. 9. Different parameters for the op amps contained in the differential amplifiers may be used, as well as different resistor values, depending on the particular application. One of skill in the art will appreciate how to determine what op amps may be used, what capacitors may be added for particular applications, and what resistor values will be appropriate for a specific intended application.

Although developed for the application of a voltage regulator for logic circuits, this disclosure may also be used to provide power to any other form of electronic circuitry.

These and other variations upon the embodiments are intended to be covered by the present disclosure, which is limited only by the appended claims.

What is claimed is:

1. A voltage regulator connected to a load, comprising:

a series regulator connected to a power supply and configured to provide a current in an amount based upon a control signal;

a shunt regulator configured to receive a portion of the current not passed through the load;

a sensor configured to determine the portion of the current received by the shunt regulator and generate the control signal based upon the determined portion of the current such that the portion of the current received by the shunt regulator remains constant.

2. A voltage regulator according to claim 1, wherein the sensor comprises a circuit for measuring the size of the determined portion of the current received by the shunt regulator.

3. A voltage regulator according to claim 1, wherein the sensor comprises a circuit for measuring a parameter of the shunt regulator indicative of the size of the determined portion of the current received by the shunt regulator.

4. A voltage regulator according to claim 3, wherein the circuit for measuring a parameter comprises a circuit for detecting an operating point of a shunt bypass device in the shunt regulator.

5. A voltage regulator according to claim 4, wherein the circuit for measuring a parameter comprises a transistor configured to detect the voltage on the gate of a transistor operating as the shunt bypass device in the shunt regulator.

6. A voltage regulator for providing a voltage at a regulator output, comprising:

a first transistor having a source configured to be connected to a power supply, a gate configured to receive a control signal, and a drain connected to the regulator output;

a first differential amplifier having a non-inverting input connected to the drain of the first transistor and an inverting input configured to be coupled to a ground through a device providing a first reference voltage, and an output configured to provide a signal based upon the difference of the non-inverting input and the inverting input;

a second transistor having a drain connected to the drain of the first transistor, a gate connected to the output of the first differential amplifier, and a source configured to be coupled to the ground through a first resistor;

a second differential amplifier having a non-inverting input connected to the source of the second transistor and an inverting input configured to be coupled to the ground through a device providing a second reference voltage, and an output configured to provide a control signal based upon the difference of the non-inverting input and the inverting input, the output of the second differential amplifier connected to the gate of the first transistor; and a second resistor configured to be connected between the regulator output and the ground.

7. The voltage regulator of claim 6 wherein the first differential amplifier comprises a plurality of additional transistors.

8. The voltage regulator of claim 6 wherein the second differential amplifier comprises a plurality of additional transistors.

9. The voltage regulator of claim 6 wherein the first differential amplifier, the second transistor and the second resistor perform a shunt regulator function.

10. The voltage regulator of claim 6 wherein the first transistor, the second differential amplifier and the second transistor perform a series regulator function.

* * * * *